US009446322B2

(12) United States Patent
Ng et al.

(10) Patent No.: US 9,446,322 B2
(45) Date of Patent: Sep. 20, 2016

(54) TOY HORSE

(71) Applicant: SCIENTIFIC PU FOAM CO., LIMITED, Tsuen Wan (HK)

(72) Inventors: Ping Fun Alex Ng, Tsuen Wan (HK); Kin Wai Ho, Tsuen Wan (HK)

(73) Assignee: SCIENTIFIC PU FOAM CO., LIMITED, Tsuen Wan (HK)

( * ) Notice: Subject to any disclaimer, the term of this patent is extended or adjusted under 35 U.S.C. 154(b) by 0 days.

(21) Appl. No.: 14/588,780

(22) Filed: Jan. 2, 2015

(65) Prior Publication Data

US 2015/0182866 A1 Jul. 2, 2015

(30) Foreign Application Priority Data

Jan. 2, 2014 (HK) ..... 14100021.7

(51) Int. Cl.
*A63G 13/06* (2006.01)

(52) U.S. Cl.
CPC ..... *A63G 13/06* (2013.01)

(58) Field of Classification Search
CPC ..... A63G 13/06
See application file for complete search history.

(56) References Cited

U.S. PATENT DOCUMENTS 2,551,071 A * 5/1951 Tyng ..... A47C 4/021 248/165
4,722,537 A 2/1988 Chau-Pin
6,626,732 B1 * 9/2003 Chung ..... A63H 3/08 446/114

FOREIGN PATENT DOCUMENTS

CN 2552571 Y 5/2003
CN 201235213 Y 5/2009
CN 201889063 U 7/2011

* cited by examiner

*Primary Examiner* — Michael Dennis
(74) *Attorney, Agent, or Firm* — Muncy, Geissler, Olds & Lowe, P.C.

(57) ABSTRACT

A toy horse having a horse body, wherein the horse body includes a saddle board, two side boards, each side board being provided with a straight horse-back panel on its top, the two side boards being arranged opposite to each other symmetrically, which makes the horse-back panel of the two side boards being coplanar, the two side boards being removably installed on the saddle board, which makes the horse-back panel of the two side boards being abutted against the bottom of the saddle board, and the bottom of two side boards being shaped curly. The toy horse allows for portability of carry, convenience of assemble and comfortableness of ride.

25 Claims, 3 Drawing Sheets

TOY HORSE

CROSS REFERENCE TO THE RELATED APPLICATION

The present invention claims the benefit and priority to Hong Kong patent application 14100021.7 filed on 2 Jan. 2014, which is incorporated herein by reference in its entirety.

TECHNICAL FIELD OF THE INVENTION

The present invention relates to the field of toys, and more particularly, to a toy horse.

BACKGROUND OF THE INVENTION

Currently, most toy horses, such as carousels, electric rocking horses, etc, are electric toys. These toy horses are expensive to make, complex in the manufacturing process, narrow range of us, and difficult to carry. In this situation, different toy manufacturers have develop a variety of toy horses that do not require the use of electricity.

China patent application CN 2008200503509, entitled "Manual Toy Horse", discloses a toy horse, which comprises a head device, a bracket, front limbs, rear limbs and a stirrup. The head device is installed on the bracket, and the base of both of the front limbs and rear limbs are provided with scrolling wheels. The toy horse also comprises a saddle support, a movable frame, a drive connector, a stirrup pole and a front limb pole. The drive connector, the support, the front limbs and the front limbs pole interlock with each other in sequence and form a first thur-bar linkage. The drive connector, the support, the rear limbs and the movable frame interlock with each other in sequence and form a second four-bar linkage. The saddle support pole is connected with the front part of the drive connector, the movable frame, the support, the front limb pole respectively interlock with the rear part of the driving connector. The stirrup pole respectively interlocks with the support and the movable frame. The drive connector, the support, the stirrup pole and the movable frame form a third four-bar linkage. The top of the stirrup is connected to the stirrup pole. This invention requires no additional external energy devices. By just utilizing human limb movements and the effect of constantly shifts in the human body weight on the manual toy horse, forward movement can be achieved. It is also easy to ride and provide safety and reliability when riding.

Another China patent application CN201020594579.6, entitled "Multi-Functional Toy Horse", also discloses a multi-functional toy horse, which comprises a skeleton and a horse body. The horse body includes a horse back and the skeleton includes a foot lever, and there are four foot levers. The horse body covers on the top of the skeleton. The horse body and the skeleton are connected and fixed. The multi-functional toy horse also includes a backrest placed on the back of the horse. The backrest and the back are connected and fixed. The backrest includes two side panels and a surrounding board. The two side boards are placed symmetrically, and the cross-section of the surrounding board is appeared in a U-shape, the side boards are connected to the lower end of the U-shape board, and the lower part of the side boards are connected and fixed with the skeleton. The sides of the backrest appear as wing shape. The multi-functional toy horse also includes a chassis which includes two symmetrical rockers and a cross arm whose base appears as an arc shape. The cross arm and the rocker are connected and fixed, and the foot levers and the cross arm are connected and fixed, and the rocker are placed in the same direction as that of the horse body. The new design of the invention has two functions of walking and rocking. By pulling out the plug and detaching the chassis, the multi-functional toy horse can move forward by the wheels. By mounting the chassis and inserting the latch for positioning, the multi-functional toy horse can be rocked. The multi-functional toy horse can conveniently be switched between the two functions of walking and rocking.

The structure of the two above-mentioned toy horses is more complicated and not easy to carry. Meanwhile, due to the presence of the transmission parts in the two above-mentioned toy horses, the two above-mentioned toy horses should partly made of rigid components, which may cause uncomfortableness when riding any of the two toy horses.

SUMMARY OF THE INVENTION

The object of this new invention is directed to the problems of existing technology in terms of their difficulties for carrying, complex structure and uncomfortable feeling when riding and provides a toy horse that is portable and simple in structure.

The technical solutions for the technical problems of this new invention are:

- a toy horse comprising a horse body 1, wherein the horse body 1 comprises:
- a saddle board 11;
- two side boards 12, each side board being provided with a straight horse-back panel 121) on its top;
- the two side boards 12 being arranged opposite to each other symmetrically, which makes the horse-back panel 121 of the two side boards 12 being coplanar;
- the two side boards 12 being removably installed on the saddle board 11, which makes the horse-back panel 121 of the two side boards 12 being abutted against the bottom of the saddle board 11; and
- the bottom of two side boards 12 being shaped curly;

and wherein the toy horse further comprises:

- a first fixing board 90, on which is provided with a first fixing hole miming through the first fixing board 90 and corresponding to the saddle board 11; and
- a second fixing board 91, on which is provided with a fourth fixing hole running through the second fixing board 91 and corresponding to the side boards 12.

Preferably, in accordance with the toy horse of the invention, each side board 12 is provided with a horse tail board 122, on the front part of which is provided with an engaging surface 123 that is perpendicular to the horse-back panel 121;

and wherein two first slots corresponding respectively to the horse tail boards 122 of the two side boards 12, are located on the rear part of the saddle board 11, in which the two horse tail boards 122 can be removably engaged into the two first slots on the saddle board 11, and engaging surface 123 of the each horse tail boards 122 is abutted against the bottom of the corresponding first slot.

Preferably, in accordance with the toy horse of the invention, the front part of the saddle board 11 is provided with a second slot, and wherein the toy horse further comprises:

- a head board 3, on rear part of which is provided with a third slot corresponding to the second slot on the saddle board 11, the third slot being removably engaged into the second slot on the saddle board 11 and the bottom of the third slot being abutted against the bottom of the second slot, thereby allowing the head board 3 to secure on the saddle board 11;

a fourth fixing board 93, on which is provided with a sixth fixing hole running through the fourth fixing board 93 and corresponding to the head board 3.

Preferably, in accordance with the toy horse of the invention, the head board 3 is provided with a first mortise running through the head board 3, each side board 12 is provided with a second mortise running through the side board 12 and corresponding to the first mortise;

and wherein the toy horse further comprises a first tenon 4 in boarded-shape that corresponds to the first mortise and the second mortise, which can be removably inserted into the first mortise on the head board 3 and the second mortise on the two side boards 12 respectively;

and wherein the first fixing board 90 is further provided with a second fixing hole running through the first fixing board 90 and corresponding to the first tenon 4.

Preferably, in accordance with the toy horse of the invention, the horse body 1 further comprises a supporting board 5, on top of which is provided with a second tenon 51, and the saddle board 11 is provided with a third mortise running through the saddle board 11 and corresponding to the second tenon 51;

the bottom of the supporting board 5 being curly in shape, the front part of the supporting board 5 being provided with a third tenon 52;

and wherein the toy horse further comprises a front leg board 6 which comprises a triangular holding plate 61 and two first extending board 62 located respectively on the two sides of the holding plate 61 and being coplanar to the holding plate 61; each first extending board 62 is provided with a fourth slot on the top, the holding plate 61 is provided with a fourth mortise running through therein and corresponding to the third tenon 52; and the front bottom each side board 12 is further provided with a fifth slot corresponding to the fourth slot on the first extending board 62;

and wherein the front leg board 6 can be inserted removably into the horse body 1, and the fourth slots on the two first extending board 62 can be engaged into the fifth slots on the two side boards 12 respectively; the second tenon 51 on the supporting board 5 is inserted into the third mortise on the saddle board 11, while the third tenon 52 of the supporting board 5 is inserted into the fourth mortise on the holding plate 61;

and wherein the toy horse further comprises a third fixing board 92, on which is provided with a fifth fixing hole running through the third fixing board 92 and corresponding to the supporting board 5;

and wherein the toy horse further comprise a fifth fixing board 94, on which is provided with an eighth fixing hole running through the fifth fixing board 94 and corresponding to the front leg board 6.

Preferably, in accordance with the toy horse of the invention, the toy horse further comprises:

a rear leg board 7 which includes a triangular first inserting board 71 and two second extending board 72 located respectively on the two sides of the first inserting board 71 that is coplanar to the first inserting board 71;

a twelfth slot being located on the top of the first inserting board 71 and a thirteenth slot being located on the top of each second extending board 72;

a fourteenth slot corresponding to the thirteenth slot on the second extending board 72 being located at the rear bottom of each side board 12;

a fifteenth slot corresponding to the twelfth slot being located at the rear bottom of the supporting board 5;

and wherein the two side boards 12 and the supporting board 5 can be removably engaged on the rear leg board 7, and the fourteenth slots on the two side boards 12 are removably engaged on the two thirteenth slots on the rear leg board 7, and the bottom of the fourteenth slot is abutted against the bottom of the corresponding thirteenth slot; the fifteenth slot on the supporting board 5 is engaged into the twelfth slot on the rear leg board 7, and the bottom of the fifteenth slot is abutted against the bottom the twelfth slot;

and wherein the fifth fixing board 94 is provided with a ninth fixing hole running through therein and corresponding to the rear leg board 7

Preferably, in accordance with the toy horse of the invention, the toy horse further comprises a reinforce board 8 which includes a triangular second inserting board 81 and two third extending boards 82 located respectively on the two sides of the second inserting board 81 and being coplanar with the second inserting board 81;

the top of the second inserting board 81 being provided with a sixteenth slot;

the top of each third extending board 82 being provided with a seventeenth slot;

the middle of the base of each side board 12 being provided with an eighteenth slot corresponding to the seventeenth slot on the reinforce board 8;

the middle bottom of the supporting board 5 being provided with a nineteenth slot corresponding to the sixteenth slot on the reinforce board 8;

and wherein the two side boards 12 and the supporting boards 5 can be removably engaged in the reinforcing board 8 respectively, the eighteenth slots on the two side boards 12 is respectively engaged in the two seventeenth slot on the reinforcing board 8, while the bottom of the eighteenth slot is abutted against the bottom of the corresponding seventeenth slot; and the nineteenth slot on the supporting board 5 is engaged in the sixteenth slot on the reinforcing board 8, while the bottom of the nineteenth slot is abutted against the bottom of the sixteenth slot;

and wherein the fourth fixing board 93 is further provided with a seventh fixing hole running through the fourth fixing board 93 and corresponding to the reinforcing board 8.

Preferably, in accordance with the toy horse of the invention, the toy horse further comprises a chest board 9 shaped as rectangular, on rear part of which is provided with a sixth slot, a seventh slot, and an eighth slot;

a ninth slot corresponding to the sixth slot on the chest board 9 being located on the front part of one side board 12 and a tenth slot corresponding to the eighth slot on the chest board 9 being located on the front part of the other side board 12;

and wherein the front part of the head board 3 is provided with an eleventh slot corresponding to the seventh slot on the chest board 9; the two side boards 12 and the head board 3 can be removably mounted on the chest board 9, while the ninth slot is located in the sixth slot, the tenth slot is located in the eighth slot, and the eleventh slot is located in the seventh slot;

and wherein the first fixing board 90 further comprises a third fixing hole running through the first fixing board 90 and corresponding to the chest board 9.

Preferably, in accordance with the toy horse of the invention, an engaging groove is disposed on the side of the first fixing board 90, the second fixing board 91, the third fixing board 92, the fourth fixing board 93 and the fifth fixing board 94, respectively.

Preferably, in accordance with the toy horse of the invention, the saddle board 11, the first tenon 4, the supporting board 5, the chest board 9, the head board 3, the reinforcing board 8, the front leg board 6, and the rear leg board are all made of EVA plastic; and the side boards 12 are both made of PU.

In accordance with the toy horse of this invention, the first fixing board, the second fixing board, the third fixing board, the forth fixing board, and the fifth fixing board can allow for portability of carry of the toy horse. And the mutual engaging mechanism of the saddle board, the first tenon, the chest board, the head board, the reinforcing board, the front leg board, the rear leg board, the supporting board, and the side boards allows for ease of assemble of the toy horse. In addition, use of EVA plastic and PU materials allows for comfortableness of riding of the toy horse.

BRIEF DESCRIPTION OF THE DRAWINGS

The features of the present invention may be clearly set forth with reference to the accompanying drawings. The invention, together with the advantages thereof may be best understood by reference to the following description taken in conjunction with the accompany drawings, wherein like reference signs identify like elements, and wherein.

DETAILED DESCRIPTION OF THE INVENTION

The structure of the toy horse of the invention will be explained in detail with reference to the accompany drawings. The description and explanatory embodiment herein are merely used to set forth the present invention, not to limit the invention.

Figure 1:
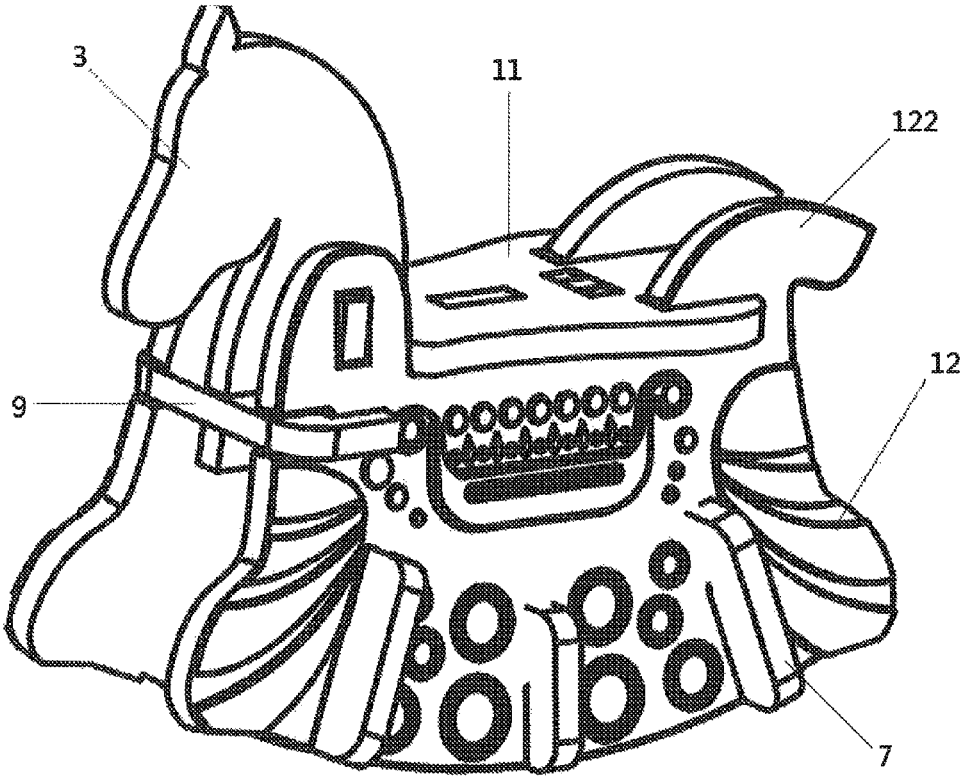
FIG. 1 is a schematic view of a toy horse of one embodiment of this invention.
Figure 2:
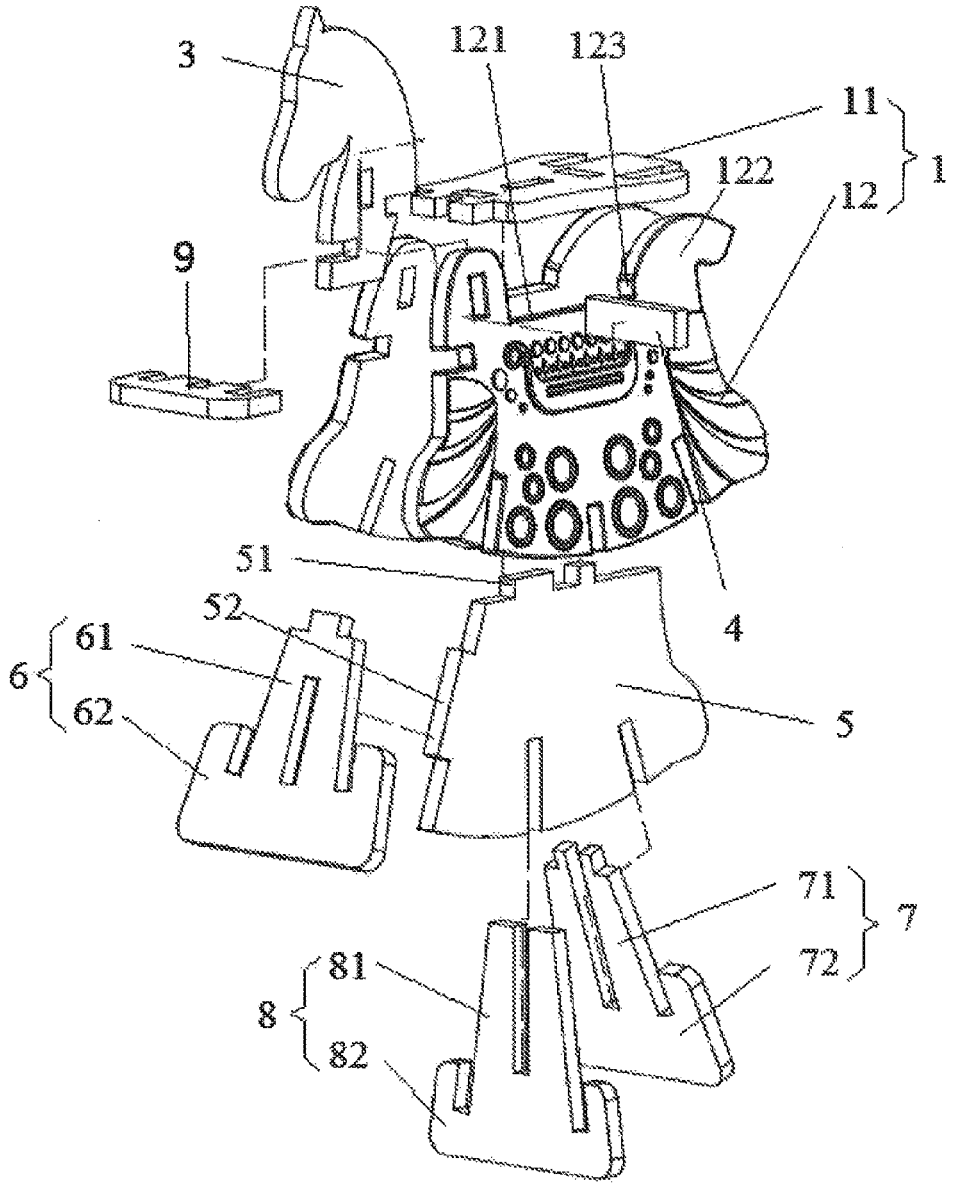
FIG. 2 is an exploded view of the toy horse shown in FIG. 1.

As illustrated in FIGS. 1 and 2, a toy horse is disclosed, which comprises a horse body 1. The horse body 1 includes a saddle board 11 and two side boards 12, and the top of each side board 12 for the horse body is provided with a straight horse-hack panel 121.

The two side boards 12 are disposed opposite to each other symmetrically, which results in the horse-back panel 121 of the two side boards 12 being coplanar with each other. The two side boards 12 can be installed removably on the saddle board 11, which made the horse-back panel 121 of the two side boards 12 is abutted against the bottom of the saddle board 11.

The two side boards 12 are inclined by a certain angle, which can be ranged from 0°-60°. Preferably, in one embodiment of the invention, the angle is 16°, by which the same experiences can be achieved when sitting on the saddle board 11 as that of the real horse.

Further, each side board 12 is provided with a horse tail board 122, the front part of which is formed an engaging surface 123 that is perpendicular to the horse-back panel 121.

The rear part of the saddle board 11 is provided with two first slots corresponding respectively to the horse tail boards 122 of the two side boards 12. The two horse tail boards 122 can be removably engaged into the two first slots on the saddle board 11. The engaging surface 123 of each horse tail board 122 is abutted against the bottom of the first slot correspondingly, thereby making that the two side boards 12 respectively are installed on the saddle board 11 thinly.

The front part of the saddle board 11 is provided with a second slot. The toy horse also includes a head board 3, the rear part of which is provided with a third slot corresponding to the second slot of the saddle board 11. The third slot can be removably engaged into the second slot of the saddle board 11, and the bottom of the third slot is abutted against the bottom of the second slot, which allows fixation of the head board 3 and the saddle board 11.

The above-mentioned installation method between the head board 3 and saddle board 11 is not secured. To make the mutual fixing between the head board 3 and saddle board 11 more secure, the head board 3 is provided with a first mortise running through the head board 3. Each side board 12 is provided with a second mortise running through the side board 12 and corresponding to the first mortise. The toy horse also includes a first tenon 4 shaped as a board that corresponds to the first mortise and the second mortise. The first tenon 4 can be removably inserted into the first mortise of the head board 3 and the second mortise on the two side boards 12. By doing so, the head board 3, the saddle board 11, and two side boards 12 can be securely fixed together via the first tenon 4.

In order to provide effective support for the saddle board 11, the horse body 1 also includes a supporting board 5, on top of which is provided with a second tenon 51. The saddle board 11 is provided with a third mortise miming through the saddle board 11 and corresponding to the second tenon 51.

Preferably, the top of the supporting board 5 is provided with two second tenons 51, and the saddle board 11 is provided with a third mortise running through the saddle board 11 and corresponding to the two second tenons 51 respectively. The bottom of the supporting board 5 is curved in shape.

The front part of the supporting board 5 is also provided with a third tenon 52; the bottom of the two side boards are both curved in shape. The toy horse also includes a front leg board 6 and a rear leg board 7. The front leg board 6 includes a triangular holding plate 61 and a first extending board 62 that is coplanar with the two holding plate 61 and is disposed on two sides of the holding plate 61 respectively. A fourth slot is located on the top of each first extending board 62, and a fourth mortise running through the holding plate 61 and corresponding to the third tenon 52 is located on the holding plate 61. A fifth slot corresponding to the fourth slot on the first extending board 62 is located on the front bottom of each side board 12.

The front leg board 6 can be inserted removably in the horse body 1, and the fourth slots on the two first extending board 62 can be removably engaged into the fifth slot on the two side boards 12. The second tenon 51 on the supporting board 5 is inserted into the third mortise of the saddle board 11, whereas the third tenon 52 of the supporting board 51 is inserted into the fourth mortise of the holding plate 61.

To enhance the appearance of the toy horse and to further secure the attachment of the head board 3 and two side boards 12, the toy horse also includes a chest board 9 which is substantially shaped as rectangular. The rear part of the chest board 9 is provided with a sixth slot, a seventh slot, and an eighth slot. The front part of one side board 12 is provided with a ninth slot corresponding to the sixth slot on the chest board 9, and the front part of the other side board 12 is provided with a tenth slot corresponding to the eighth slot on the chest board 9. The front part of the head board 3 is provided with an eleventh slot corresponding to the seventh slot on the chest board 9. The two side boards 12 and the head board 3 can be removably installed on the chest board 9, while the ninth slot is engaged into the sixth slot, the tenth slot is engaged into the eighth slot, and the eleventh slot is engaged into the seventh slot.

Further, the rear leg board 7 includes a triangular first inserting board 71 and two second extending board 72 that are coplanar with the first inserting board 71 and are placed on the two sides of the inserting board 71 respectively. A twelfth slot is disposed on the top of the first inserting board 71, and a thirteenth slot is disposed on the top of each second extending board 72. A fourteenth slot is disposed at the rear part of the bottom of each side board 12, which corresponds to the thirteenth slot of the second extending board 72. A fifteenth slot is located at the rear part of the bottom of the supporting board 5, which corresponds to the twelfth slot. The two side boards 12 and the supporting board 5 can be removably engaged on the rear leg board 7, and the fourteenth slots on the two side boards 12 can be removably engaged into the two thirteenth slots on the rear leg board 7. The bottom of the fourteenth slot is abutted against the bottom of the corresponding thirteenth slot. The fifteenth slot on the supporting board 5 is engaged into the twelfth slot on the rear leg board 7, and the bottom of the fifteenth slot is abutted against the bottom of the twelfth slot.

The front leg board 6 is inclined by an angle ranged from 0° to 180° with respect to the rear leg board 7. Preferably, in one embodiment of the invention, the angle is 40°.

Preferably, in one embodiment of the invention, the toy horse also includes a reinforcing board 8, which includes a triangular second inserting board 81 and two third extending board 82 that is coplanar with the second inserting board 81 and disposed on two sides of the second inserting board 81 respectively. The top of the second inserting board 81 is provided with a sixteenth slot, the top of each third extending board 82 is provided with a seventeenth slot, the middle bottom of each side board 12 is provided with an eighteenth slot corresponding to the seventeenth slot on the reinforcing board 8, and the middle bottom of the supporting board 5 is provided with a nineteenth slot corresponding to the sixteenth slot on the reinforcing board 8. The two side boards 12 and the supporting boards 5 can be removably engaged on the reinforcing board 8 respectively, and the eighteenth slots on the two side boards 12 can be respectively engaged into the two seventeenth slots on the reinforcing board 8, while the bottom of the eighteenth slot is abutted against the bottom of the seventeenth slot. The nineteenth slot on the supporting board 5 is engaged into the sixteenth slot on the reinforcing board 8, and the bottom of the nineteenth slot is abutted against the bottom of the sixteenth slot.

Figure 3:
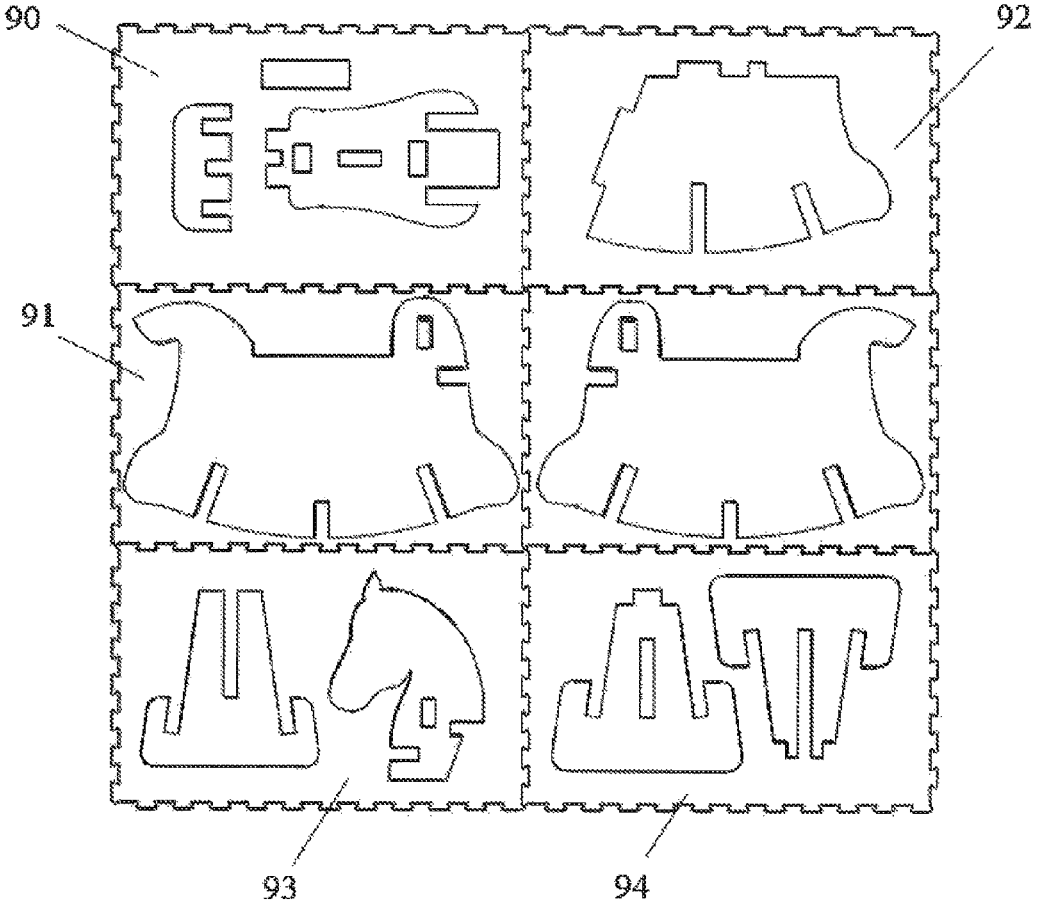
FIG. 3 is a schematic view of a carpet formed by the toy horse shown in FIG. 1.

Further, as shown in FIG. 3, in one embodiment of the invention, the toy horse also includes a first fixing board 90, on which a first fixing hole running through the first fixing board 90 and corresponding to the saddle board 11 is provided. The saddle board 11 can be inserted into the first fixing hole, which makes the saddle board 11 and the first fixing board 90 being coplanar.

Preferably, a second fixing hole running through the first fixing board 90 and corresponding to a first tenon 4 is located on the first fixing board 90. The first tenon 4 can be inserted into the second fixing hole, which makes the first tenon 4 and the first fixing board 90 being coplanar.

Preferably, a third fixing hole running through the first fixing board 90 and corresponding to the chest board 9 is located on the first fixing board 90. The chest board 9 can be inserted into the third fixing board, which makes the chest board 9 and the first fixing board 90 being coplanar.

Further, in one embodiment of the invention, the toy horse also includes a second fixing board 91, on which a fourth fixing hole running through the second fixing board 91 and corresponding to the side boards 12 is provided. The side board 12 can be inserted into the fourth fixing hole, which makes the side board 12 and the second fixing board 91 being coplanar.

In this embodiment, the toy horse includes two second fixing boards 91.

Further, in one embodiment of the invention, the toy horse also includes a third fixing board 92, on which a fifth fixing hole miming through the third fixing board 92 and corresponding to the supporting board 5 is provided. The supporting board 5 can be inserted into the fifth fixing hole, which makes the supporting board 5 and the third fixing board 92 being coplanar.

Further, in one embodiment of the invention, the toy horse also includes a fourth fixing board 93, on which a sixth fixing hole running through the fourth fixing board 93 and corresponding to the head board 5 is provided. The head board 3 can be inserted into the sixth fixing hole, which makes the head board 3 and the fourth fixing board 93 being coplanar.

Preferably, the fourth fixing board 93 is further provided with a seventh fixing hole running through the fourth fixing board 93 and corresponding to the reinforcing board 8. The reinforcing board 8 can be inserted into the seventh fixing hole, which makes the reinforcing board 8 and the fourth fixing board 93 being coplanar.

Further, in one embodiment of the invention, the toy horse also includes a fifth fixing board 94, on which an eighth fixing hole running through the fifth fixing board 94 and corresponding to the front leg board 6 is provided. The front leg board 6 can be inserted into the eighth fixing hole, which makes the front leg board 6 and the fifth fixing board 94 being coplanar.

Preferably, the fifth fixing board 94 is further provided with a ninth fixing hole running through the fifth fixing board 94 and corresponding to the rear leg board 7. The h rear leg board 7 can be inserted into the ninth fixing hole, which makes the rear leg board 7 and the fifth fixing board 94 being coplanar.

The first fixing board 90, the second fixing board 91, the third fixing board 92, the fourth fixing board 93 and fifth fixing board 94 are all shaped as rectangular, and have the same length, width, and depth.

The saddle board 11, the first tenon 4, the chest board 8, the side boards 12, the supporting board 5, the head board 3, the reinforcing board 8, the front leg board 6, and the rear leg board 7 can be secured respectively by the first fixing board 90, the second fixing board 91, the third fixing board 92, the fourth fixing board 93 and the fifth fixing board 94. Meanwhile, the unified shape of the first fixing board 90, the second fixing board 91, the third fixing board 92, the fourth fixing board 93 and the fifth fixing board 94 allow for portability of carry of the toy horse.

Preferably, the saddle board 11, the first tenon 4, the supporting board 5, the chest board 9, the head board 3, the reinforcing board 8, the front leg board 6, and the rear leg board 7 are all made of EVA (ethylene-vinyl acetate copolymer) plastic, while the side board 12 are made of PU (polyurethane). It should be understood that in addition to EVA and PU, the saddle board 11, the first tenon 4, the supporting board 5, the chest board 9, the head board 3, the reinforcing board 8, the front leg board 6, and the rear leg board 7, and the side board 12 can be made of other materials, such as EPE (Expandable Polyethylene).

The first fixing board 90, the second fixing board 91, the third fixing board 92, the fourth fixing board 93, and the fifth fixing board 94 are all provided with engaging grooves on the sides thereof Any two of the first fixing board 90, the second fixing board 91, the third fixing board 92, the fourth fixing board 93, and the fifth fixing board 94 can be attached together through their own engaging grooves, by which the toy horse of this invention can be changed to form a carpet as shown in FIG. 3. While a particular embodiment of the invention has been shown and described, it will be obvious to those skilled in the art that changes and modifications can be made without departing from the true spirit and scope of the invention. It should be understood that the embodiments of the present invention described above are illustrative only, and all the changes and modifications made by those skilled in the art are covered by the appended claims.

What is claimed is:

1. A toy horse comprising a horse body, wherein the horse body comprises:

a saddle board;

two side boards, each side board being provided with a straight horse-back panel on its top;

the two side boards being arranged opposite to each other symmetrically, which makes the horse-back panel of the two side boards being coplanar;

the two side boards being removably installed on the saddle board, which makes the horse-back panel of the two side boards being abutted against the bottom of the saddle board; and the bottom of two side boards being shaped curly; and wherein the front part of the saddle board is provided with a second slot, and wherein the toy horse further comprises:

a head board, on rear part of which is provided with a third slot corresponding to the second slot on the saddle board, the third slot being removably engaged into the second slot on the saddle board and the bottom of the third slot being abutted against the bottom of the second slot, thereby allowing the head board to secure on the saddle board, and wherein the head board is provided with a first mortise running through the head board, each side board is provided with a second mortise running through the side board and corresponding to the first mortise; and wherein the toy horse further comprises a first tenon in boarded-shape that corresponds to the first mortise and the second mortise, which can be removably inserted into the first mortise on the head board and the second mortise on the two side boards respectively.

2. The toy horse according to claim 1, wherein each side board is provided with a horse tail board, on the front part of which is provided with an engaging surface that is perpendicular to the horseback panel; and wherein two first slots corresponding respectively to the horse tail boards of the two side boards, are located on the rear part of the saddle board, in which the two horse tail boards can be removably engaged into the two first slots on the saddle board, and engaging surface of the each horse tail boards is abutted against a lateral surface perpendicular to the horseback panel of the corresponding first slot.

3. The toy horse according to claim 1, wherein the horse body further comprises a supporting board, on top of which is provided with a second tenon, and the saddle board is provided with a third mortise running through the saddle board and corresponding to the second tenon; the bottom of the supporting board being curly in shape, the front part of the supporting board being provided with a third tenon; and wherein the toy horse further comprises a front leg board which comprises a triangular holding plate and two first extending board) located respectively on the two sides of the holding plate and being coplanar to the holding plate; each first extending board is provided with a fourth slot on the top, the holding plate is provided with a fourth mortise running through therein and corresponding to the third tenon; and the front bottom each side board is further provided with a fifth slot corresponding to the fourth slot on the first extending board; and wherein the front leg board can be inserted removably into the horse body, and the fourth slots on the two first extending board can be engaged into the fifth slots on the two side boards respectively; the second tenon on the supporting board is inserted into the third mortise on the saddle board, while the third tenon of the supporting board is inserted into the fourth mortise on the holding plate.

4. The toy horse according to claim 3, wherein the toy horse further comprises: a rear leg board which includes a triangular first inserting board and two second extending board located respectively on the two sides of the first inserting board that is coplanar to the first inserting board; a twelfth slot being located on the top of the first inserting board and a thirteenth slot being located on the top of each second extending board; a fourteenth slot corresponding to the thirteenth slot on the second extending board being located at the rear bottom of each side board; a fifteenth slot corresponding to the twelfth slot being located at the rear bottom of the supporting board; and wherein the two side boards and the supporting board can be removably engaged on the rear leg board, and the fourteenth slots on the two side boards are removably engaged on the two thirteenth slots on the rear leg board, and the bottom of the fourteenth slot is abutted against the bottom of the corresponding thirteenth slot; the fifteenth slot on the supporting board is engaged into the twelfth slot on the rear leg board, and the bottom of the fifteenth slot is abutted against the bottom the twelfth slot.

5. The toy horse according to claim 4, wherein the toy horse further comprises a reinforce board which includes a triangular second inserting board and two third extending boards located respectively on the two sides of the second inserting board and being coplanar with the second inserting board; the top of the second inserting board being provided with a sixteenth slot; the top of each third extending board being provided with a seventeenth slot; the middle of the base of each side board being provided with an eighteenth slot corresponding to the seventeenth slot on the reinforce board; the middle bottom of the supporting board being provided with a nineteenth slot corresponding to the sixteenth slot on the reinforce board; and wherein the two side boards and the supporting boards can be removably engaged in the reinforcing board respectively, the eighteenth slots on the two side boards is respectively engaged in the two seventeenth slot on the reinforcing board, while the bottom of the eighteenth slot is abutted against the bottom of the corresponding seventeenth slot; and the nineteenth slot on the supporting board is engaged in the sixteenth slot on the reinforcing board, while the bottom of the nineteenth slot is abutted against the bottom of the sixteenth slot.

6. The toy horse according to claim 5, wherein the toy horse further comprises a chest board shaped as rectangular, on rear part of which is provided with a sixth slot, a seventh slot, and an eighth slot; a ninth slot corresponding to the sixth slot on the chest board being located on the front part of one side board and a tenth slot corresponding to the eighth slot on the chest board being located on the front part of the other side board; and wherein the front part of the head board is provided with an eleventh slot corresponding to the seventh slot on the chest board; the two side boards and the head board can be removably mounted on the chest board, while the ninth slot is located in the sixth slot, the tenth slot is located in the eighth slot, and the eleventh slot is located in the seventh slot.

7. The toy horse according to claim 6, wherein the saddle board, the first tenon, the supporting board, the chest board, the head board, the reinforcing board, the front leg board, and the rear leg board are all made of EVA plastic; and the side boards are both made of PU.

8. The toy horse according to claim 1, further comprising a first fixing board provided with a first fixing hole running through the first fixing board and corresponding to the saddle board.

9. The toy horse according to claim 1, further comprising a second fixing board provided with a fourth fixing hole running through the second fixing board and corresponding to the side boards.

10. The toy horse according to claim 1, further comprising a fourth fixing board provided with a sixth fixing hole running through the fourth fixing board and corresponding to the head board.

11. The toy horse according to claim 1, further comprising a first fixing board provided with a second fixing hole running through the first fixing board and corresponding to the first tenon.

12. The toy horse according to claim 3, further comprising a third fixing board provided with a fifth fixing hole running through the third fixing board and corresponding to the supporting board.

13. The toy horse according to claim 3, further comprising a fifth fixing board provided with an eighth fixing hole running through the fifth fixing board and corresponding to the front leg board.

14. The toy horse according to claim 4, further comprising a fifth fixing board provided with a ninth fixing hole running through therein and corresponding to the rear leg board.

15. The toy horse according to claim 5, further comprising a fourth fixing board provided with a seventh fixing hole running through the fourth fixing board and corresponding to the reinforcing board.

16. The toy horse according to claim 6, further comprising a first fixing board provided with a third fixing hole running through the first fixing board and corresponding to the chest board.

17. The toy horse according to claim 8, wherein the first fixing board is provided with engaging grooves on its sides.

18. The toy horse according to claim 9, wherein the second fixing board is provided with engaging grooves on its sides.

19. The toy horse according to claim 10, wherein the fourth fixing board is provided with engaging grooves on its sides.

20. The toy horse according to claim 11, wherein the first fixing board is provided with engaging grooves on its sides.

21. The toy horse according to claim 12, wherein the third fixing board is provided with engaging grooves on its sides.

22. The toy horse according to claim 13, wherein the fifth fixing board is provided with engaging grooves on its sides.

23. The toy horse according to claim 14, wherein the fifth fixing board is provided with engaging grooves on its sides.

24. The toy horse according to claim 15, wherein the fourth fixing board is provided with engaging grooves on its sides.

25. The toy horse according to claim 16, wherein the first fixing board is provided with engaging grooves on its sides.

* * * * *